US009809776B2

(12) United States Patent
Loh et al.

(10) Patent No.: US 9,809,776 B2
(45) Date of Patent: Nov. 7, 2017

(54) MOULD RELEASE LUBRICANT

(71) Applicant: MALAYSIAN PALM OIL BOARD, Selangor (MY)

(72) Inventors: Soh Kheang Loh, Selangor (MY); Yuen May Choo, Selangor (MY)

(73) Assignee: MALAYSIAN PALM OIL BOARD, Selangor (MY)

( * ) Notice: Subject to any disclaimer, the term of this patent is extended or adjusted under 35 U.S.C. 154(b) by 0 days.

(21) Appl. No.: 14/891,946

(22) PCT Filed: May 19, 2014

(86) PCT No.: PCT/MY2014/000106

§ 371 (c)(1),
(2) Date: Nov. 17, 2015

(87) PCT Pub. No.: WO2015/034343

PCT Pub. Date: Mar. 12, 2015

(65) Prior Publication Data

US 2016/0090543 A1 Mar. 31, 2016

(30) Foreign Application Priority Data

May 20, 2013 (MY) ..... PI 2013001845

(51) Int. Cl.
*B28B 7/38* (2006.01)
*B28B 1/093* (2006.01)
*C10M 105/36* (2006.01)

(52) U.S. Cl.
CPC ..... *C10M 105/36* (2013.01); *B28B 7/384* (2013.01)

(58) Field of Classification Search
CPC ..... C10M 105/36; B28B 7/384; B28B 7/36; B28B 7/362; B28B 7/64; B28B 7/366
See application file for complete search history.

(56) References Cited

U.S. PATENT DOCUMENTS 5,100,697 A * 3/1992 Nielsen ..... B28B 7/384 427/133
5,641,734 A * 6/1997 Naegely ..... C10M 169/044 508/233
6,429,175 B1 * 8/2002 Stuart, Jr. ..... C10M 129/40 508/136

(Continued)

FOREIGN PATENT DOCUMENTS

AU WO 0226458 A1 * 4/2002 ..... B28B 7/384
JP 6144604 3/1986

(Continued)

*Primary Examiner* — Pamela H Weiss
(74) *Attorney, Agent, or Firm* — Workman Nydegger

(57) ABSTRACT

A mould release lubricant comprises of palm-derived base fluid and a specialty additive of satisfactory mould release and lubrication properties such as a tackifier, and if deemed necessary, other additives to improve the lubrication of the mould, is disclosed. The lubricant comprises at least one vegetable base fluid and/or its derivatives having good low temperature fluidity property, and at least one tackifier. The mould release lubricant disclosed in the present invention is used in construction industry (especially concrete construction) for lubrication during the process of detaching the moulded concrete from the mould (formwork) and prevents adhesion of freshly placed concrete to the forming surface.

10 Claims, 5 Drawing Sheets

Figure 1:
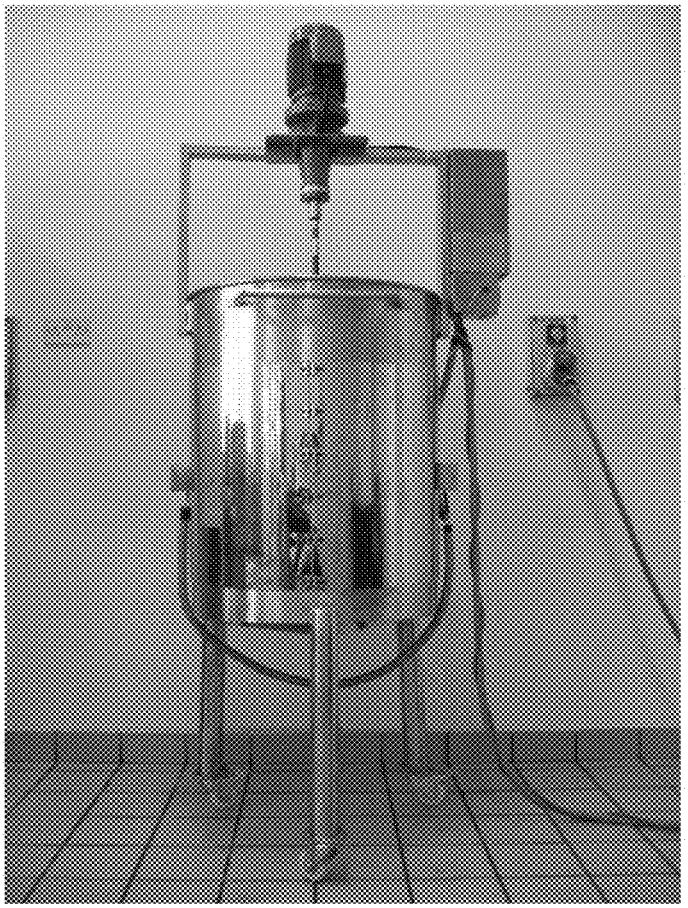

A 200-L capacity mixer tank for blending of palm-based mould oil

(56) References Cited

U.S. PATENT DOCUMENTS

| | | | | |
|---|---|---|---|---|
| 6,500,789 | B1 * | 12/2002 | Wiltz | C10M 169/04 508/472 |
| 6,620,230 | B1 * | 9/2003 | Wiethorn | B28B 7/384 106/38.2 |
| 7,842,746 | B2 * | 11/2010 | Bloom | C08F 8/04 524/270 |
| 2003/0040444 | A1 * | 2/2003 | Garmier | C10M 169/044 508/491 |
| 2003/0068426 | A1 * | 4/2003 | Idris | A23D 9/013 426/601 |
| 2003/0152707 | A1 * | 8/2003 | Hassan | D21H 19/18 427/384 |
| 2003/0229168 | A1 * | 12/2003 | Borsinger | C09J 123/0853 524/275 |
| 2004/0241309 | A1 * | 12/2004 | Garmier | A23D 9/00 426/601 |
| 2005/0059562 | A1 * | 3/2005 | Garmier | C10M 111/02 508/437 |
| 2006/0211585 | A1 * | 9/2006 | Garmier | C10M 169/04 508/491 |
| 2008/0293602 | A1 * | 11/2008 | Kodali | C07C 43/178 508/463 |
| 2010/0225026 | A1 * | 9/2010 | Madsen | B28B 7/384 264/338 |

FOREIGN PATENT DOCUMENTS

| | | |
|---|---|---|
| JP | 2000-96015 | 4/2000 |
| WO | WO03035809 | 5/2003 |

* cited by examiner

*A 200-L capacity mixer tank for blending of palm-based mould oil*

*Agitation and heating system of the mixer tank*

*Mould oil stain (visibly darker concrete blocks for poor performance mould oil)*

*no breakage and no oil stain on finished concrete*

*Finished concrete after being cut into blocks*

MOULD RELEASE LUBRICANT

FIELD OF INVENTION

The present invention relates to a process of producing mould oil/releasing agent which is more popularly referred to as "mould release agent" from palm olein and/or its derivatives having good low temperature fluidity property.

BACKGROUND ART

In concrete/steel block production, mould release agent is used for lubrication during the process of detaching the moulded concrete from the mould (formwork) and prevents adhesion of freshly placed concrete to the forming surface. At present, petroleum-based fluid is used as the mould release agent. This material is normally produced in an unpleasant environment as petroleum-based mould release lubricants are used in the workplaces involving pre-cast and construction-related concreting operations. The frequent use of this oil causes health problems and has a negative environmental impact in the workplaces, as the products are flammable (with strong petrol odour), toxic and has unpleasant odour.

Due to the increased environmental awareness and ever-increasing price of the present commercial mould oil originated from petroleum-based fluid, the search for a "greener" alternative especially that can take care of the environment has been actively carried out. Moreover, employers and workers directly involved in the industry themselves are increasingly asking for building ingredients and construction processes that have a lower environmental impact due to the real health risks created by the use of the toxic lubricants and mould release agents in the workplaces. The search for non-toxic, renewable and biodegradable mould release lubricants which can be termed as "green" is indeed very important.

Previously, mould release agents were manufactured from mineral oils and waxes with incorporation of a chemical compound having good release property such as oleic acid. The mould release agents were evolved into oil-in-water emulsion (Nielsen, PCT Publication No. WO 8505066 A1, 1985) taking in the triglyceride from vegetable oil, aliphatic carboxylic acid ester, non-ionic and anionic surfactant or antioxidant and polyacrylate (Wittich et al., German Patent Publication No. 4400272 A1; 1995) to improve release of a moulded concrete piece. There was also a more advance technology of manufacturing the oil-in-water mould release agent using industrial wastes such as vegetable oils and engine oils (Yi, China Patent No. 1129633; 1996). Other vegetable oil-based mould release agent with sealing effect was also invented to prevent the passage of water into the concrete (Lightcap, U.S. Pat. No. 5,647,899; 1997). It was derived from a non-refined vegetable oil; which can be derived from sources such as, but not limited to coconut oil, corn oil, palm oil, cottonseed oil, rapeseed oil, soy oil and sunflower oil or a mixture thereof and an emulsifier. To overcome property drawbacks such as oxidation resistance, anti-wear, corrosion resistance, viscosity stability and tackiness, thus, vegetable oil can be suitably used as a mould release lubricant by formulations to incorporate proper designed specialty additives into the lubricant compositions, to suit the intended use of the lubricants formulated.

Lafay V S and Neltner S L in United States of America Patent Publication No. US 2002172759 A1 disclosed a biodegradable mould release agent comprising of vegetable oil, mineral seal oil (viscosity reducer), alcohol or mixture thereof with the incorporation of a filler and oleic acid. It could reduce adhesion between concrete and formwork or mould, thus improve the life of the forms. All the improved mould release agents invented so far exhibited chemical rather than a barrier (physical) release. This means that the mould release agents produce a thin, harmless soap between the concrete's surface and the mould itself, thus produce a smooth finish to the concrete. This will ensure less volume of mould release agents used than the traditional agents, and offers protection of steel mould casings from corrosion.

In EU, concrete release agents are usually based on rapeseed and soy oil and esters. The 'Blue-Angel' approved concrete release agents in Holland have been marketed successfully (distributed by Elf and Total) (Theodori et al., Concept paper on development of criteria for the award of the European Eco-label to lubricants; 2004). Although the use of vegetable oils have been highly recommended as they are renewable, biodegradable and environmentally friendly and have superior lubrication properties, they have not found wide applicability in high-performance loss lubricants such as mould release agent due to the lack of effective viscosity and oxidative stability and tackiness in its ability to release a formed material when subjected to thermal stresses from its mould compared to conventional lubricants or synthetic lubricants. Palm oil being a natural vegetable oil and with inherited lubricity property and corrosion inhibition (Loh and Choo, J. Oil Palm Research Vol. 24: 1388-1396; 2012), is a potential base fluid suitably used as an alternative to mitigate the environment issue and cost associated with the use of commercial petroleum-based mould release lubricants in current workplace. It is found effective too in preventing concrete adhesion to aluminum (Freedman, PUBLICATION # C750084 The Aberdeen Group; 1975). It is important that the proposed alternative is able to satisfy all these requirements and possibly still remains competitive.

A new mould release lubricant derived from palm olein has been pursued. Present invention concentrates on formulating palm olein and/or its derivatives having good low temperature fluidity property into a mould release agent having optimum performance fulfilling every aspect of the specifications for greener mould oil used in concrete production besides ensuring that the production process and the finished concrete units conform to higher standards and more stringent conditions and regulations. Besides being cheaper compared to other vegetable oils, the manufacturing process of palm-based mould release lubricant is rather straightforward. Thus it has a great opportunity to be emerged as a cheaper product in the market. This will open up another business opportunity to palm oil industry in adding values to palm oil.

The naturally occurring vegetable oils having utility in the present invention comprise at least one of, but not limited to palm oil, soybean oil, rapeseed oil, sunflower oil, coconut oil, canola oil, peanut oil, corn oil, cottonseed oil, safflower oil, meadow foam oil or castor oil.

SUMMARY OF INVENTION

One aspect of the present invention is to provide a process for the production of a mould release agent; wherein the process includes the steps of blending/mixing a vegetable base fluid with a specialty additive material at a temperature of between 50° C. to 70° C. and at an atmospheric pressure of between 500 torr to 1000 torr.

A further aspect of the present invention is to describe a mould release agent composition, wherein the composition further includes other additives with various properties deemed necessary for preferred intended use.

In another aspect of the present invention is the ingredient concentration for the blending/mixing of the vegetable based fluid and the additive used.

The present invention consists of several novel features and a combination of parts hereinafter fully described and illustrated in the accompanying drawing, it being understood that various changes in the details may be made without departing from the scope of the invention or sacrificing any of the advantages of the present invention.

BRIEF DESCRIPTION OF THE ACCOMPANYING DRAWINGS

Figure 2:
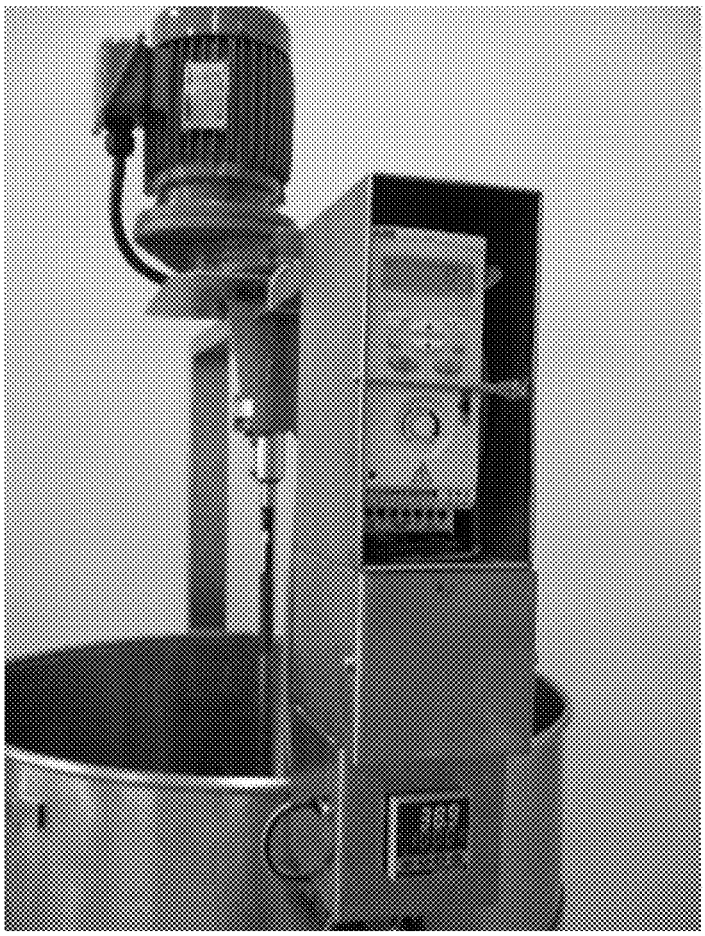
Figure 3:
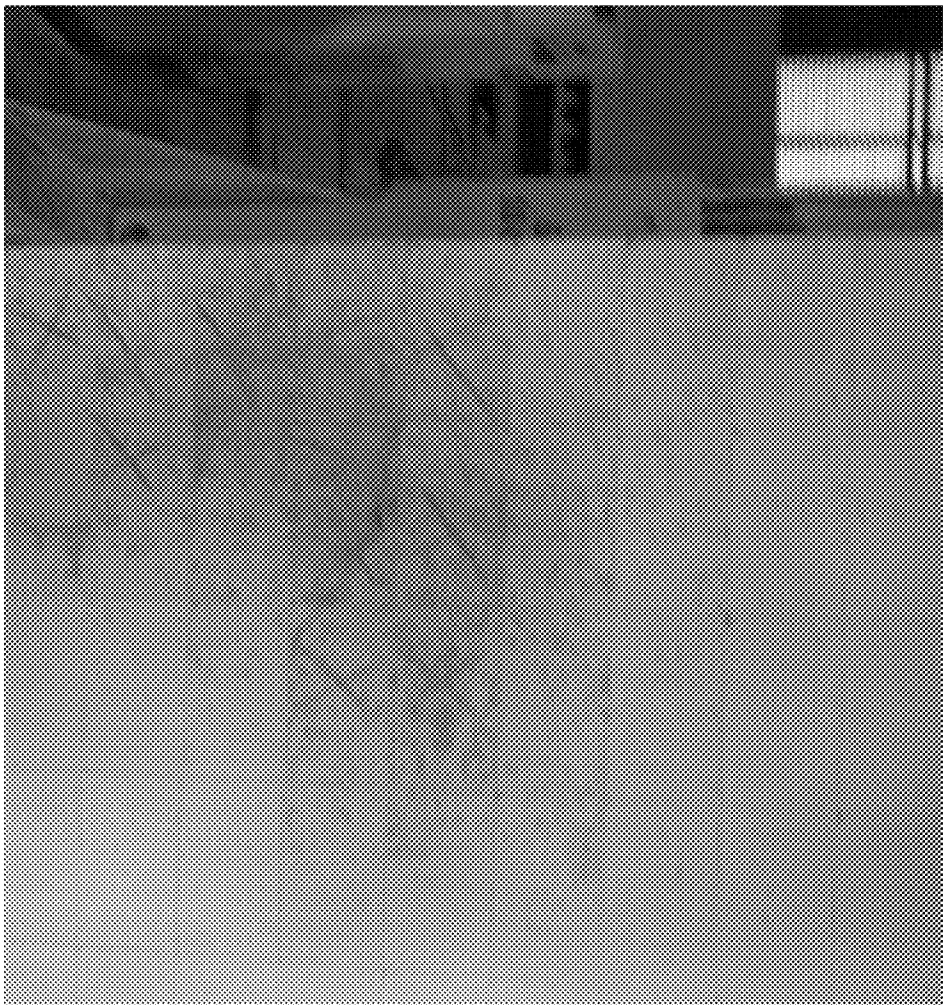
Figure 4:
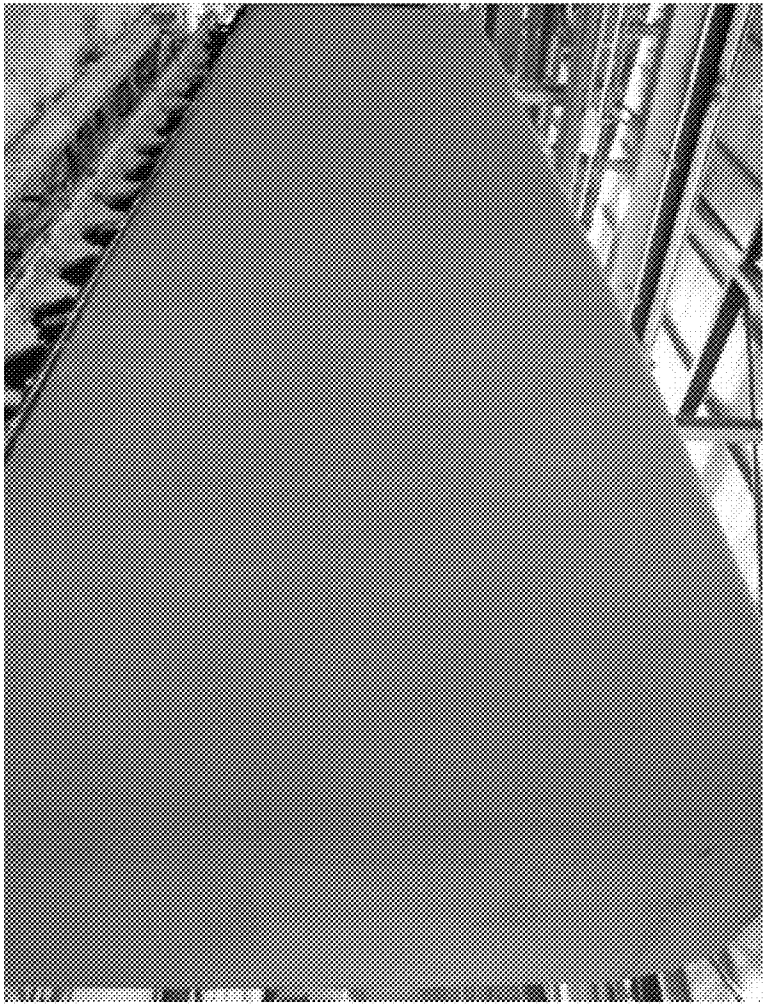
Figure 5:
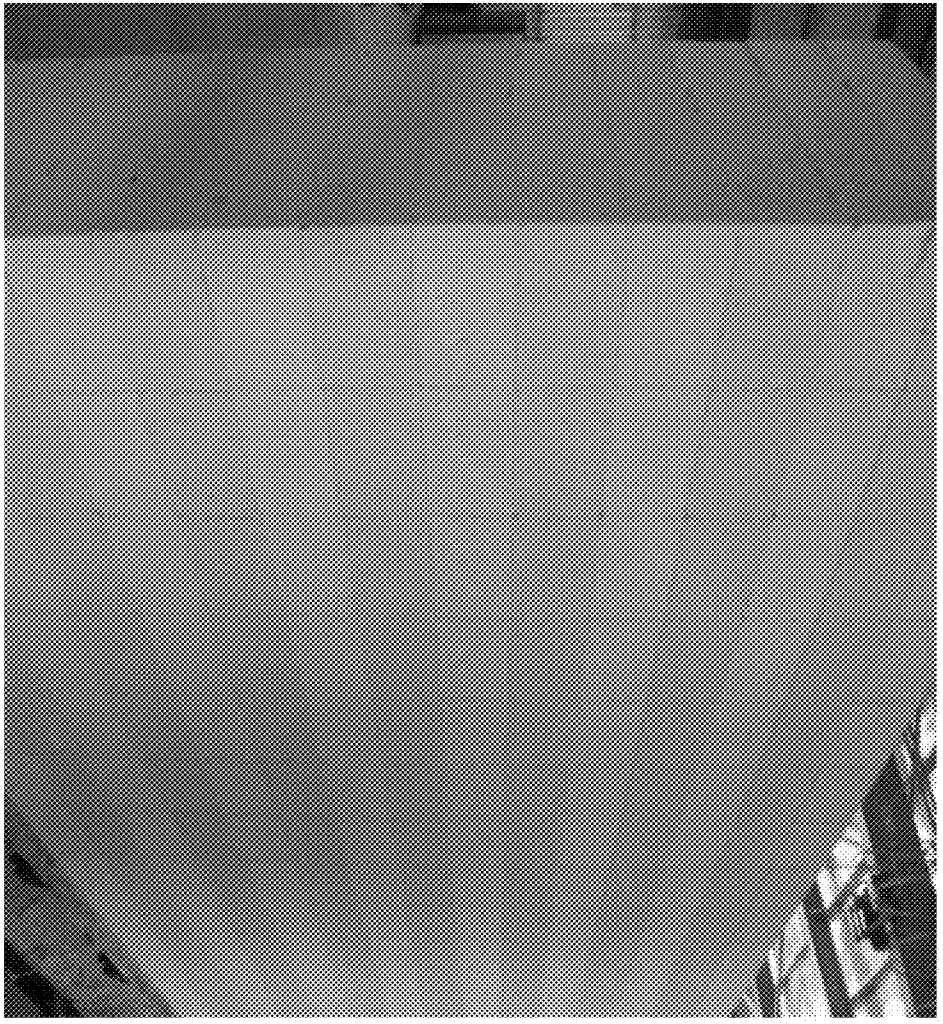

To further clarify various aspects of some embodiments of the present invention, a more particular description of the invention will be rendered by references to specific embodiments thereof, which are illustrated, in the appended drawings. It is appreciated that these drawings depict only typical embodiments of the invention and are therefore not to be considered limiting of its scope. The invention will be described and explained with additional specificity and detail through the accompanying drawings in which:

FIG. 1 and FIG. 2 show a mixer tank with a blending capacity of up to 200 L for the production of a mould release lubricant using the optimum formulation recipe according to the preferred embodiments of the present invention. The mixer tank requires 0.4 kW/415 V for the smooth operation of an agitator motor, and a heater to heat up the blending ingredients. It is mobile and therefore this can facilitate the relocation of the tank on the factory production floor FIG. 3 shows the mould oil stain with visibly darker concrete blocks due to poor performance mould oil used FIG. 4 shows the finished concrete with no oil stain on the surface due to optimized blend of mould release agent as disclosed in the present invention FIG. 5 shows the finished concrete after being cut into blocks with no oil stain on the surface due to optimized blend of mould release agent as disclosed in the present invention.

DETAILED DESCRIPTION OF THE PREFERRED EMBODIMENTS

The present invention relates to a mould release agent from palm olein and/or its derivatives having good low temperature fluidity property. Mould release agent is used in construction industry (especially concrete construction) for lubrication during the process of detaching the moulded concrete from the mould (formwork) and prevents adhesion of freshly placed concrete to the forming surface. Hereinafter, this specification will describe the present invention according to the preferred embodiments of the present invention. However, it is to be understood that limiting the description to the preferred embodiments of the invention is merely to facilitate discussion of the present invention and it is envisioned that those skilled in the art may devise various modifications and equivalents without departing from the scope of the appended claims.

A mould release lubricant having superior mould release property is particularly useful in commercial concrete block or steel production where lubrication is required during the process of detaching the moulded concrete/steel from the mould. It exhibits chemical rather than a barrier release, produces a smooth finish to the concrete, ensures less volume of mould release agent used and protects steel mould casings from corrosion. In another word, it has good lubricity, chemical release and corrosion inhibition property.

The present invention is a food grade mould release lubricant which comprises of a base fluid originated from palm oil, and at least a tackifier; all of which are National Sanitation foundation (NSF)-certified HX-1 ingredients for food grade lubricant formulation. The base fluid of the present invention is a naturally occurring vegetable oil preferably a fractionated palm oil known as a palm olein and possibly incorporated with a synthesized derivative that has good property in low temperature fluidity.

A suitable tackifier is a lubricant additive containing a polymer that provides tackiness and thickening effect to the mould release lubricant formulated. A suitable tackifier used in this invention is sold under the trade name Functional V-584, which consist of a polymer that provides tackiness and thickening effect. The trackifier sold under that trade name Functional V-584is understood to include about 80% wt. vegetable oil and at least 20% wt. of a copolymer. The copolymer is understood to be an ethylene acetate copolymer with a weight ratio of vinyl acetate to ethylene being from about 25 vinyl acetate to about 75 ethylene, to about 55 vinyl acetate to about 45 ethylene, with an average molecular weight of about 500 to about 10,000 Da. The preferred range of the tackifier is 8 wt % to 10 wt %.

Dependent on what functions the mould release lubricant is intended for use, other specialty additives (such as metal deactivator, antioxidant, antiwear, viscosity improver, low pour point depressant etc.) can also be blended in to perform the desired properties required for a said lubricant.

Corrosion inhibitor is not required in palm-based lubricants formulation as the base fluid utilised in the invention has already had inherited protection against corrosion (Loh and Choo, J. Oil Palm Research Vol. 24: 1388-1396; 2012). However, in any formulation, the additive can be used if required to enhance the corrosion protection property.

The present invention discloses formulation technology for a mould release lubricant utilizing a base fluid containing a major portion of triglyceride oil, optionally including palm olein and/or other palm-based fluid with incorporation of permitted quantities of NSF approved specialty additives for use in formulating H-1 lubricants with incidental food contact, preferably in concrete/steel manufacturing. It is to be made clear that the specialty additive other than those being certified by NSF can also be used.

The base fluids suitable for use in this invention are naturally occurring vegetable oils or modified vegetable oils or synthetic vegetable oil. The naturally occurring vegetable oils having utility in this invention comprise at least one of palm oil, soybean oil, rapeseed oil, sunflower oil, coconut oil, lesquerella oil, canola oil, peanut oil, corn oil, cottonseed oil, safflower oil, meadowfoam oil, or castor oil. The preferred range of the base fluid is 50 wt % to 100 wt %, most preferably from 70 wt % to 99 wt %.

The targeted synthetic vegetable oil in this invention should be those exhibit good low temperature palm olein derivatives, and these can be produced and blended into the present mould release lubricant invented. The said derivatives can range from methyl and ethyl esters, polyol esters to various other derivative oleochemicals from palm oil. The preferred range of the derivative is 0 wt % to 100 wt %, or any other cost-effective compositions deem necessary to improve the lubricant's fluidity property in temperate climate.

The amount of base fluid required for mould release lubricants formulation is between 70 wt % to 99 wt %, whereas the additives ranges fall within the permitted treat level approved by NSF; and optionally containing tackifier between 8 wt % to 10 wt %, The above formulation can also be blended with other naturally occurring vegetable oil including soybean oil, rapeseed oil, sunflower oil, coconut oil, canola oil, peanut oil, corn oil, cottonseed oil, safflower oil, meadowfoam oil or castor oil in appropriate composition to meet the desired lubrication property required for its formulation.

There are certain process parameters that need to be controlled so as to ensure the mould release lubricant of the present invention is produced within the desired qualities. The mixing of the base fluid and the additive is conducted at a temperature between 50° C. to 70° C. to avoid any chemical changes to the oils and additives used. The pressure used is at normal atmospheric pressure. Mixing rate for the blending compositions should be as fast as possible for complete homogeneous mixing.

The base fluid employed in mould release lubricant production is palm olein having characteristics as shown in Table 1. By mixing or blending it with the tackifier, V584 in the proportions described below, the mould release lubricant can be successfully formulated.

TABLE 1

CHARACTERISTICS OF PALM OLEIN USED

| Characteristics | Specification |
|---|---|
| Iodine value, IV (Wij's) | 56-58 |
| Free fatty acids, FFA (% as palmitic acid) | 0.05-0.10 |
| Moisture (%) | 0.03-0.10 |
| Slip melting point (° C.) | 22-24 |
| Cloud point (° C.) | 7.4 |
| Color (5¼" Lovibond Cell) | 2.6-3.0 Red |

The following are examples of the compositions of mould release lubricant formulated in embodiment 1 to embodiment 4 of this invention. The mould release lubricants formulated exhibit good to superior characteristics and performance in concrete/steel manufacturing. Some of their characteristic lubricating properties vs. commercial mould oil are tabulated in Table 2.

TABLE 2

COMPARISON ON LUBRICATING PROPERTIES* OF PALM-BASED MOULD OIL vs. COMMERCIAL MOULD OIL AND PALM OLEIN

| Property | Palm Olein (pure blend) | Palm-Based Mould Oil, palm olein:additive (90:10) | Commercial Mould Oil |
|---|---|---|---|
| Density at 25° C. (kg/L) | 0.8975 | 0.9090 | 0.8838 |
| Viscosity, kinematic @ 40° C./100° C. (cSt), ASTM D445 | 41.66/8.47 | 58.42/11.29 | 107.52/18.76 |
| Viscosity Index, ASTM D2270 | 186 | 191 | 195 |
| Moisture Content (%), ASTM D1744 | 0.027-0.085 | 0.5095 | 0.072 |
| Pour Point (° C.), ASTM D97 | 6.0 | 6.0 | −3.0 |
| Cloud Point (° C.), ASTM D93 | 6.6-7.4 | 9.4 | −5.2 |
| Total Acid Number (TAN) (mg/g), ASTM D664 | 4.60 | 0.8 | 3.92 |
| Free fatty acids (FFA), (%) | 0.057-0.10 | 0.76 | NA |

TABLE 2-continued

COMPARISON ON LUBRICATING PROPERTIES* OF PALM-BASED MOULD OIL vs. COMMERCIAL MOULD OIL AND PALM OLEIN

| Property | Palm Olein (pure blend) | Palm-Based Mould Oil, palm olein:additive (90:10) | Commercial Mould Oil |
|---|---|---|---|
| Copper strip corrosion, ASTM D130 | 1a | 1a | 1a |
| Oxidative stability (hr), EN 14112 | 22.6-28.0 | 22.83 | NA |
| Oxidative Stability by RPVOT (min), ASTM D2272 | 14 | 72 | NA |
| Flash point (° C.), ASTM D93 | 305 | 340 | 246 |

*These characteristics are typical of this batch production. Future production will conform to MPOB's specification, in which variations in these characteristics may occur.
**The pour point can be lowered to meet the cold climate requirement with the incorporation of palm derivatives in different percentages.

For Embodiment 1: The mould release lubricant comprises of 100% palm olein as the mould release lubricant.

For Embodiment 2: The mould release lubricant comprises of 90% of palm olein as the base fluid and 10% of Functional V-584, and agitated at 60° C. and 350 rpm using the mixing tank as shown in FIG. 1 and FIG. 2 to produce a premium grade mould release lubricant For Embodiment 3: The mould release lubricant comprises of 93% of palm olein as the base fluid and 7% of Functional V-584, and agitated at 60° C. and 350 rpm using the mixing tank as shown in FIG. 1 and FIG. 2 to produce a mould release lubricant.

For Embodiment 4: The mould release lubricant comprises of 50% of palm olein and 43% of a palm derivative as the base fluid and 7% of Functional V-584, and agitated at 60° C. and 350 rpm using the mixing tank as shown in FIG. 1 and FIG. 2 to produce a mould release lubricant having superior low temperature fluidity.

In order to conduct an evaluation for the mould release lubricants formulated in the present invention, the measurements below were carried out.

1. Kinematic Viscosity at 40° C.: carried out by a viscometer bath (Ubbelohde Viscometer) according to ASTM test method D445.
2. Viscosity index: carried out on the basis of ASTM D2270.
3. Specific gravity at 25° C.: carried out by a digital density meter.
4. Moisture content: carried out by Kals Fisher method.
5. Total Acid Number (TAN): carried out on the basis of ASTM D664.
6. FFA: via MPOB test methods p2.5
7. Pour point and cloud point: carried out by an automatic pour point/cloud point measuring apparatus (ISL CPP 97-2 Analyzer) according to ASTM test method D97 and D2500.
8. Rotating Pressure Vessel Oxidative Test (RPVOT): carried out by a measuring device according to a modified ASTM D2272 method in dry condition.
9. Demulsibility test: carried out on the basis of ASTM D1401.
10. Copper strip corrosion: carried out on the basis of ASTM D130.
11. Oxidative stability via the Rancimat method was measured using a Model 743 Rancimat instrument (Metrohm AG, Switzerland).

12. The fatty acid compositions (FAC) of all samples were determined according to ISO 5508: Animal and vegetable fat and oil analysis by gas-liquid chromatography of methyl esters of fatty acids.

The performance of the formulated mould release lubricants via field trials at the collaborator's production plant was assessed. The small scale trial was conducted using palm oil without adding any additives as an experimental control. The performance of the palm-based mould oil was comparable to the petroleum-based mould oil, with tolerable noticeable soft concrete surfaces that retain the mould oil as oil dots on the surfaces.

The mould release lubricant comprising of palm olein and/or its derivatives and appropriate amount of specialty additive was found performing well in all the mould cars it was applied to in the big scale field trials conducted. It is found that there was no more oil dot area on the finished goods, no concrete leftover sticking in the inner wall of the mould car when the concrete is detached from the mould and no cake broken during de-moulding process. Blending of palm olein and/or its derivatives with a tackifier in different concentration ratios was attempted to improve the lubricant's mould release characteristics, low temperature fluidity and kinematic viscosity.

Methods:

Step 1). All the ingredients (base fluid and additive) were weighed using an analytical balance.

Step 2). Example of embodiment 2 - palm olein and the tackifier were poured into a mixer tank and circulated by heat.

Step 3). A mechanical stirrer was put into the mixer tank and the mixture was stirred vigorously at motor speed of 300-400 rpm. The temperature used to facilitate the dissolution of the additives in palm olein is 50-70° C. The blending mixture was stirred for 30 mins to an hour for getting the most homogeneous blend required.

The preferable temperature used in Step 3 is at 65° C. and the preferable mixing time is 30 mins.

The mould release lubricant of the present invention differs from other previously invented lubricants, in that this lubricant is derived from base stock of naturally occurring palm oil and enhanced by different treat level of a food grade specialty additive. This product will emerge as a green product suitable for use in H1 lubricants with incidental food contact in various activities requiring mould release ability as well as for non-food grade applications.

It is to be noted that the present illustration does not have any intent for the present invention to be limited to the specific embodiments described therein. The above formulations are not intended to limit the invention. Other base fluids from naturally occurring vegetable oils, modified vegetable oils or synthetic vegetable oil, and any of the commercial or synthesized food grade additives or petroleum-based additives that are compatible with the base fluid used can be utilised in this invention. The described embodiments are to be considered in all respects only as illustrative and not restrictive. The scope of the invention is, therefore indicated by the appended claims rather than by the foregoing descriptions. All changes, which come within the meaning and range of equivalency of the claims, are to be embraced within their scope.

The invention claimed is:

1. A process for the production of a mould release lubricant formulated to form concrete without staining a surface of the concrete, wherein the process comprises:

blending or mixing a) a vegetable oil base fluid; and b) a tackifier additive included in a range between 7% to 10% by weight of the mould release lubricant, at a temperature of between 50° C. to 70° C. and at an atmospheric pressure of between 500 torr to 1000 torr; and applying the mould release lubricant as a barrier between a concrete mould and a concrete surface, the mould release lubricant enabling release of the concrete from the concrete mould without causing oil stains on the concrete surface.

2. The process as claimed in claim 1, wherein the vegetable oil base fluid is derived from one or more vegetable oils including naturally occurring vegetable oils, modified vegetable oils, or synthetic vegetable oil.

3. The process as claimed in claim 2, wherein the one or more vegetable oils are selected from palm oil, soybean oil, rapeseed oil, sunflower oil, coconut oil, lesquerella oil, canola oil, peanut oil, corn oil, cottonseed oil, safflower oil, meadowfoam oil, or castor oil.

4. The process as claimed in claim 1, wherein the vegetable oil base fluid comprises palm olein and wherein the vegetable oil base fluid is included in a range of about 90% to 93% by weight of the mould release lubricant.

5. The process as claimed in claim 1, wherein the vegetable oil base fluid comprises palm olein and/or its derivatives.

6. The process as claimed in claim 1, wherein the vegetable oil base fluid is included in a range of 70% by weight to 93% by weight of the mould release lubricant.

7. The process as claimed in claim 1, wherein the tackifier additive is included in a range between 8 wt % to 10 wt %.

8. The process as claimed in claim 1, wherein the composition further includes one or more other additives to improve its lubrication properties, the one or more other additives comprising at least one of a metal deactivator, anti-oxidant, anti-wear, pour point depressant, or viscosity improver.

9. The process as claimed in claim 5, wherein the palm olein derivatives are selected from methyl esters, ethyl esters, and polyol esters.

10. The process as claimed in claim 1, further comprising producing a soap film between the concrete surface and the concrete mould as a result of application of the mould release lubricant to the concrete mould and the concrete surface.

* * * * *